US005487448A

United States Patent [19]

Schollkopf et al.

[11] Patent Number: 5,487,448

[45] Date of Patent: Jan. 30, 1996

[54] DEVICE FOR MONITORING A CONTROL UNIT

[75] Inventors: Karl-Otto Schollkopf, Esslingen; Werner Böhm, Weinstadt; Gerhard Kellings, Moers; Michael Bollerott, Essen; Klaus Scherer, Düsseldorf, all of Germany

[73] Assignees: Thyssen Aufzuge GmbH, Neuhausen; Fraunhofer-Gesellschaft zur Forderung der angewandten Forschung e.V., Munich, both of Germany

[21] Appl. No.: 344,517

[22] Filed: Nov. 23, 1994

Related U.S. Application Data

[63] Continuation of Ser. No. 956,773, filed as PCT/EP92/00853, Apr. 16, 1992, abandoned.

[30] Foreign Application Priority Data

Apr. 18, 1991 [DE] Germany ..... 41 12 626.2

[51] Int. Cl.[6] ..... B66B 5/00; B66B 13/16

[52] U.S. Cl. ..... 187/247; 324/202; 187/277; 187/280; 187/393

[58] Field of Search ..... 187/390, 391, 187/393, 394, 315, 280, 277, 247; 324/202, 207.2

[56] References Cited

U.S. PATENT DOCUMENTS

| | | | |
|---|---|---|---|
| 3,054,475 | 9/1962 | Moser et al. . | |
| 3,625,312 | 12/1971 | Hunter | 187/48 |
| 4,002,973 | 1/1977 | Wiesendanger et al. | 324/73 R |
| 4,568,909 | 2/1986 | Whynacht | 340/21 |
| 4,710,955 | 12/1987 | Kauffman | 380/10 |
| 4,831,362 | 5/1989 | Traprazis | 340/515 |
| 4,898,263 | 2/1990 | Manske et al. . | |
| 4,977,984 | 12/1990 | Arnosti et al. | 187/394 |
| 5,107,964 | 4/1992 | Coste et al. | 187/104 |
| 5,247,139 | 9/1993 | Schon et al. . | |
| 5,343,145 | 8/1994 | Wellman et al. | 324/202 |
| 5,360,952 | 11/1994 | Brajczewski et al. | 187/246 |
| 5,383,535 | 1/1995 | Ando | 187/247 |

FOREIGN PATENT DOCUMENTS

| | | | |
|---|---|---|---|
| 0032213 | 12/1980 | European Pat. Off. | B66B 1/16 |
| 0298784 | 1/1989 | European Pat. Off. . | |
| 357888 | 3/1990 | European Pat. Off. . | |
| 483560 | 5/1992 | European Pat. Off. . | |
| 2432928 | 1/1975 | Germany . | |
| 3430061 | 2/1986 | Germany . | |
| 3934974 | 2/1991 | Germany . | |
| 2110388 | 6/1983 | United Kingdom . | |
| 2136158 | 9/1984 | United Kingdom | B66B 23/02 |

*Primary Examiner*—Peter S. Wong
*Assistant Examiner*—Robert Nappi
*Attorney, Agent, or Firm*—Barry R. Lipsitz

[57] ABSTRACT

The invention relates to a monitoring device for a control unit having a safety chain. In accordance with the invention, the monitoring device has a testable switching device which is provided with input and output terminals such that a monitoring loop may be set up from a plurality of testable switching devices and a sequence of digital signals can, in particular, be transmitted via this loop as a continuous signal so that a "digital stand-by current loop" is obtained.

20 Claims, 2 Drawing Sheets

DEVICE FOR MONITORING A CONTROL UNIT

Figure 1:
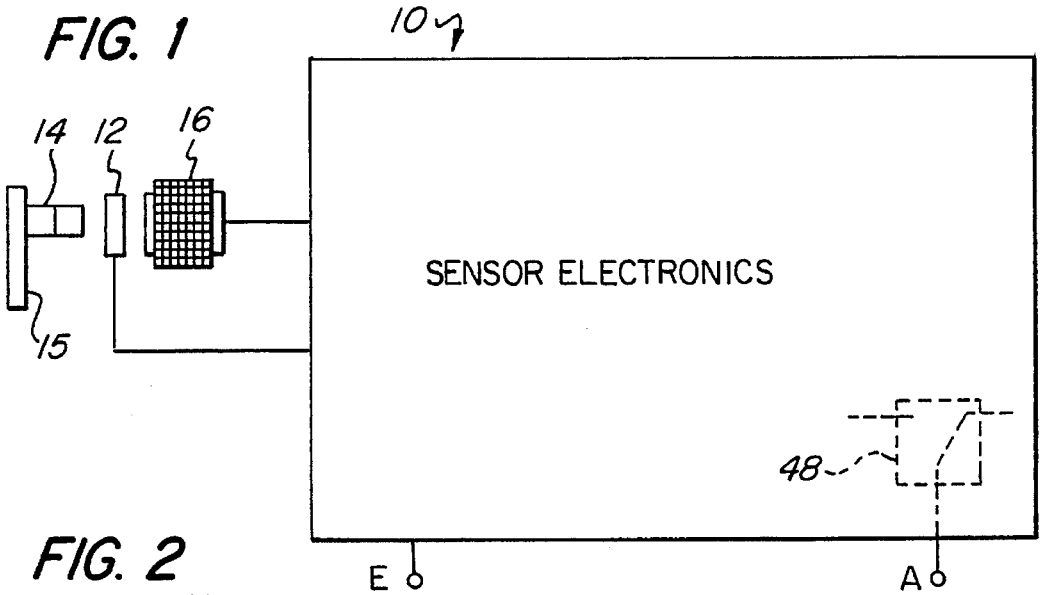

This application is a continuation of commonly assigned, U.S. patent application Ser. No. 07/956,773 filed as PCT/EP92/00853, Apr. 16, 1992 now abandoned.

The invention relates to a device for monitoring a control unit comprising a safety chain, in particular for elevator and conveyor systems.

In various electromechanical systems, in particular in elevator and conveyor systems, individual actions, for example travel of the elevator or the actuation of a conveyor device, are monitored with the aid of switching devices. Often, a number of these must have a specific switching state in order to be able to perform the intended action reliably.

In particular, it must be ensured in the case of an elevator system that prior to the elevator car starting and while it is running all the doors are closed and remain mechanically locked. Likewise, it must be ensured, for example, in the case of hydraulic collision buffers that the buffers are completely extended before the car can be started during normal operation.

In systems of the type in question, mechanical safety switches are often used at the various "safety points", at which the position of movable components, such as, e.g., doors, must be monitored prior to the initiation of an action and, if necessary, during the course of this action. A number of these safety switches are, in particular, connected in series to form a so-called "safety chain" so that the action can only be started or continued when all the safety switches or, in more general terms, switching devices take up a predetermined switching state.

In the case of all electromechanical safety switches, considerable problems result with respect to the provision of faultless electrical contacts since the mechanical touching of the contact elements can lead to a contact readjustment and, moreover, it is always difficult to set the switch point. Furthermore, electromechanical switches of this type are subject to considerable wear and tear and the risk of soiling during operation. On the whole, functional errors can easily occur during use of electromechanical safety switches which cause a stoppage of the monitored system, whereby the frequency of the functional errors increases considerably in safety chains having numerous switching contacts. The consequence of this is that, for example, in conveyor systems and elevators a large proportion of the operational stoppages is attributable to some form of switch defect.

A certain improvement of the situation described in the above results when using electronic switches or sensors which can be actuated without contact, for example by moving a magnet closer or farther away. With these switches, the switch point is generally easier to set and also remains stable during longer operating periods. Moreover, the causes of stoppages which are attributable in electromechanical switches to a wear and tear of the contact pieces and other movable components are no longer applicable. (In contrast to mechanical safety switches, however, there is no enforced operation during actuation).

Nevertheless, it would also be important for this type of switch to test for faultless functioning and, moreover, to be able to ascertain as simply as possible in the case of a breakdown which switch in a safety chain has led to a functional error and interrupted the chain. Unlike mechanical switches, the switching state of magnet-operated electronic switches cannot be ascertained optically, as is the case in typical mechanical safety switches.

Especially in elevator systems, a simple test possibility would be particularly important since these have a large number of safety switches which are never actuated during normal operation but are intended to function in case of emergency. With these switches, previous function testing was often carried out only at lengthy intervals of time since the parts to be monitored had to be moved for testing, which was all the more problematic, the more difficult it was for a mechanic to reach the relevant switch or the relevant part to be monitored for testing.

In principle, it is possible, for ascertaining the point of interruption, to connect each switching device individually with a control which involves high material and assembly costs. The individual switching devices can also be connected to the control via bus connections and, in this case, can be interrogated in the desired sequence concerning their respective switching state, whereby the interrogation does, however, require an ever increasing amount of time, the greater the number of safety points.

Proceeding on the basis of the state of the art and the problems explained in the above, the object underlying the invention is to specify an improved monitoring device which enables a reliable control for elevator and conveyor systems having a safety chain and exacting safety requirements to be realized at relatively low cost.

This object is accomplished in accordance with the invention, for a monitoring device of the type specified at the outset, in that it comprises a non-contact, electronic, testable switching device having a sensor and control electronics for detecting the state of the sensor and altering this state for test purposes, the control electronics comprising input and output terminals for producing connections serving to exchange data with a primary control, whereby the input and output terminals are designed such that they can be connected with the input and output terminals of additional switching devices to form a monitoring loop which can be connected to the primary control and has a branch ascending from this control and a branch leading back to this control, and the control electronics comprising an electronic changeover switch, the returning branch of the monitoring loop being interruptable for the switching devices further removed from the control when this changeover switch is switched to a state not fulfilling the safety criterion of the safety chain.

It is a particular advantage of the inventive monitoring device, or the switching device forming this monitoring device, that the electronic changeover switch of the control electronics can be used, as in a mechanically actuatable switching device, as a switch of a safety chain or a safety switch chain.

It is, however, particularly advantageous for the monitoring device to comprise additional testable switching devices and a primary control since this offers the possibility of setting up a monitoring loop by connecting the switching devices with one another. A continuous signal can then be applied to the input side end of the monitoring loop from an output of the primary control and any interruption of the continuous signal can be detected at the output side end of the monitoring loop at an input to the primary control. In this way, it is possible to obtain a so-called stand-by current loop with the inventive monitoring device which, in a further development of the invention with a continuous signal in the form of a defined sequence of pulses, more or less forms a "digital stand-by current loop".

Additional advantageous developments of the invention are the subject matter of additional claims.

Figure 2:
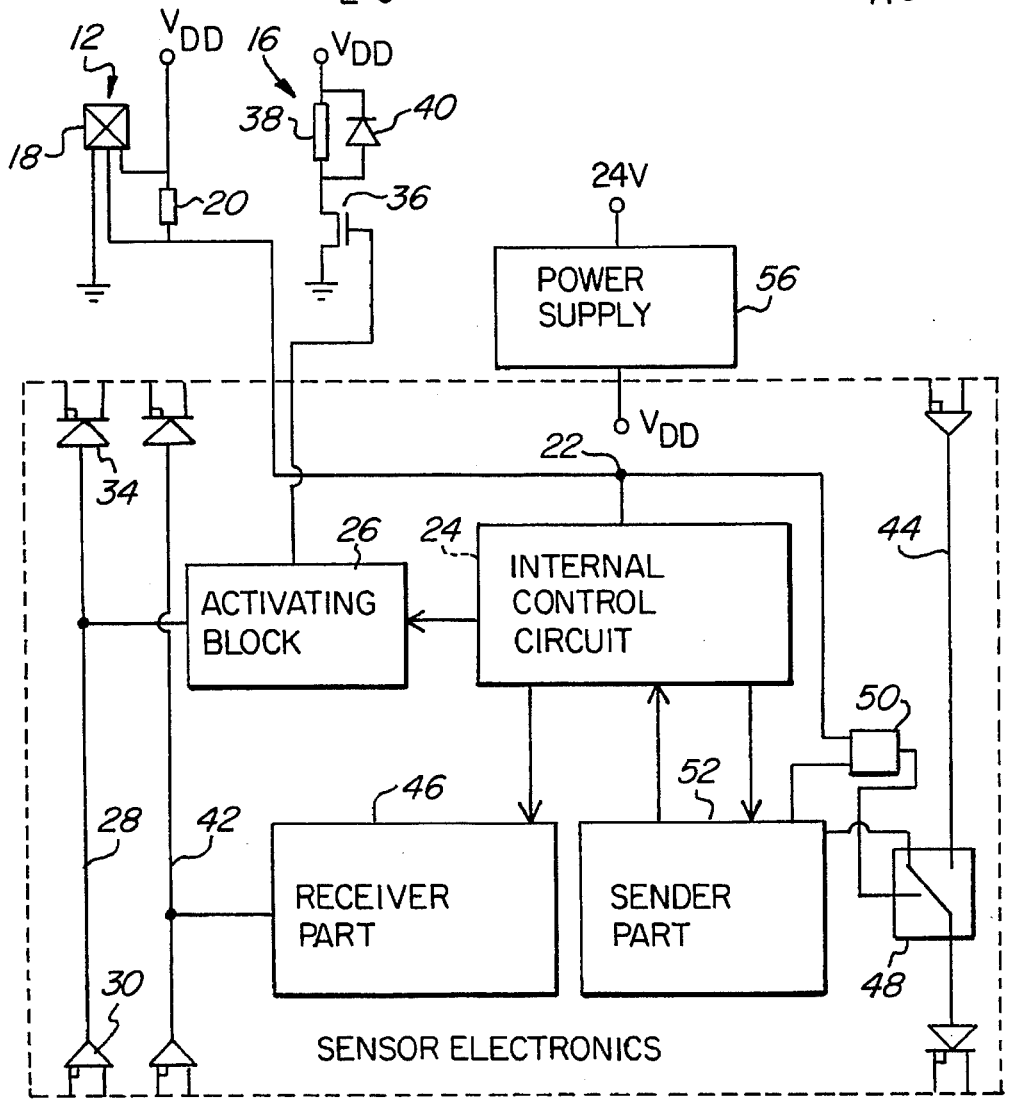
Figure 3:
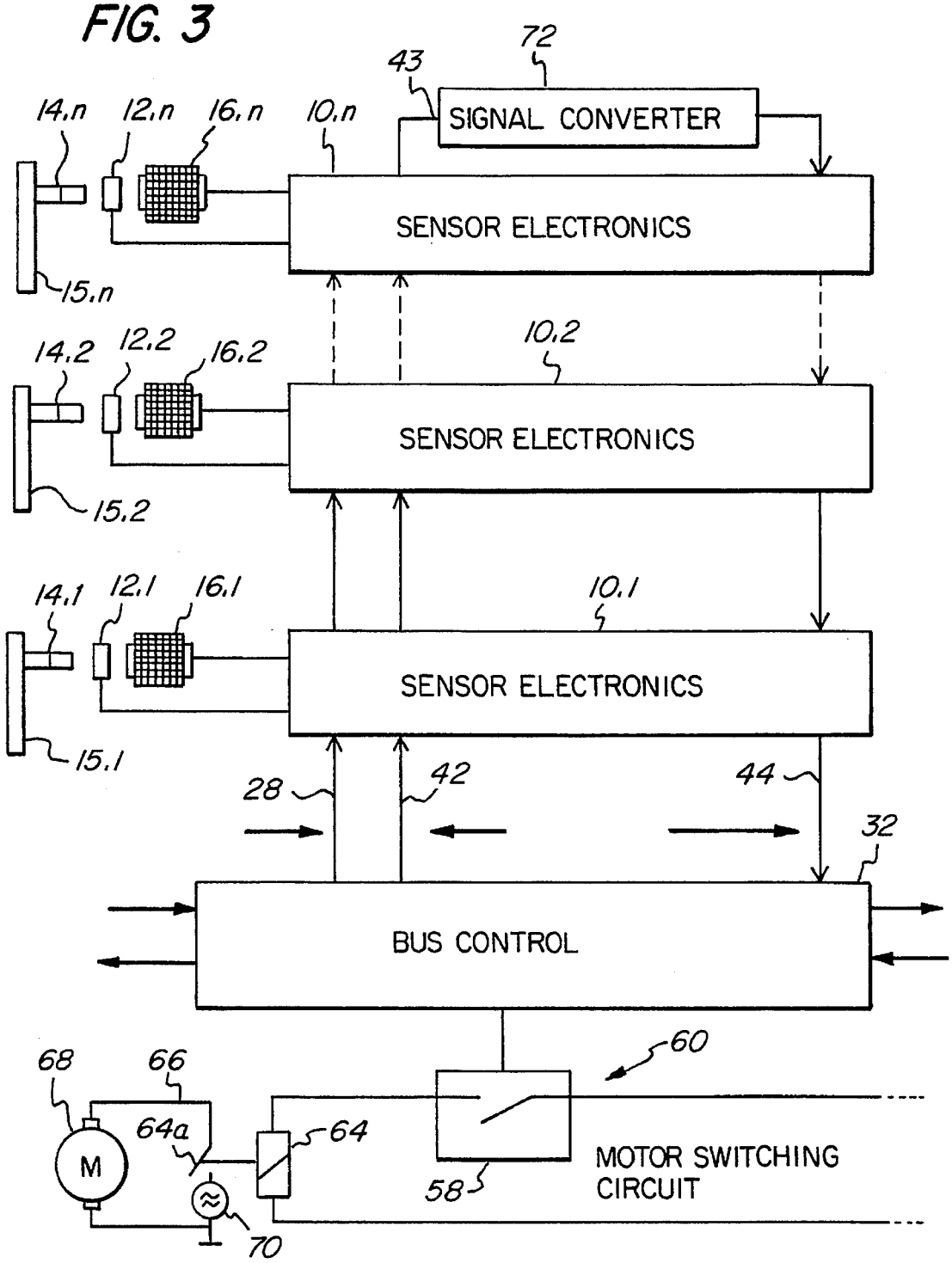

Additional details and advantages of the invention will be explained in greater detail in the following on the basis of drawings. In these drawings, FIG. 1 is a very schematized basic circuit diagram of an inventive monitoring device in the form of a single electronic switching device;

FIG. 2 is a detailed illustration of the switching device according to FIG. 1; and FIG. 3 is a schematic circuit diagram of a control unit comprising an inventive monitoring device for an elevator system.

In detail, FIG. 1 shows schematically an inventive monitoring device in the form of a non-contact, electronic switching device comprising sensor electronics 10 and a magnetic field sensor 12 which comprises, for example, a Hall element and responds to an external magnetic field. This external magnetic field can be generated, for example, by a permanent magnet 14 which is customarily attached to a displaceable component 15 which is to be monitored, i.e., for example, an elevator door. As long as the sensor 12 is located outside the effective range of the external magnetic field generated by the permanent magnet 14, the sensor 12 delivers a signal, with which an electronic (changeover) switch 48 of the sensor electronics 10, which is indicated by dashed lines, is held in a "non-actuated" state, in particular in the opened state. When, proceeding from the aforementioned state, the permanent magnet 14 approaches the sensor 12 as far as a predetermined minimum distance, then the specified switch is switched over into its "actuated" state, in particular into its closed state, so that a corresponding control signal is emitted at an output A of the sensor electronics 10 and, therefore, of the switching device as a whole, this control signal indicating that the displaceable component 15 with the permanent magnet 14 is located in the position required, in particular, for safety reasons for performing a specific action.

In order to create, in an electronic switching device of the type under consideration, a test possibility which allows the faultless operation of this electronic switching device to be monitored, a magnetic coil 16 is provided which is dimensioned and arranged relative to the sensor 12 such that with its help a magnetic field can be generated in the region of the sensor 12 which can compensate the effect of the magnetic field of the permanent magnet 14 present in the detection range of the sensor 12.

When the permanent magnet 14 is located in front of the sensor 12 in its position shown in FIG. 1 and the electronic switching device consequently assumes its actuated state, the exciting current which can then be generated for the magnetic coil 16 with the aid of the sensor electronics 10 in accordance with the invention is such that the magnetic fields of the permanent magnet 14, on the one hand, and of the magnetic coil 16, on the other, compensate one another in the detection range of the sensor 12. This means that the influence of the permanent magnet on the sensor 12 is neutralized so that, due to the activation of the magnetic coil 16, the switching device must transfer to its non-actuated state for the duration of the activation of the magnetic coil 16 when its elements are operating faultlessly. Therefore, for testing the faultless functioning of the electronic switching device it must merely be ascertained whether, proceeding from the actuated state of the switching device, the non-actuated state of the switching device can be brought about for the duration of the excitation of the magnetic coil 16. Only when this is, in fact, the case can it be assumed that the electronic switching device and the active sensor element are functioning without fault.

It is particularly advantageous for the switching device under consideration to be designed such that the function test is carried out each time prior to the initiation of an action monitored by the switching device, whereby in response to the planned action a corresponding signal is applied to an input E of the sensor electronics 10 in order to bring about a corresponding activation of the magnetic coil 16. If required, the function test can also be carried out periodically at suitable, short intervals, whereby the timing for the test procedures can be generated by means of a suitable timing generator in the sensor electronics itself.

Whereas in the above it has been assumed that during the function test the permanent magnet 14 must take up such a position that the switching device is in its actuated state, it is clear on the basis of the preceding explanations that due to the presence of the magnetic coil 16 it is possible for tests to be carried out even when the sensor 12 is located outside the range of influence of the magnetic field of the permanent magnet 14. When, namely, the sensor 12 is not affected by the external magnetic field of the permanent magnet 14, the flow of an exciting current through the magnetic coil 16 must then result in the switching device being changed over from the non-actuated state into the actuated state since, in this case, the magnetic field of the permanent magnet 14, which counteracts the magnetic field of the coil, is lacking. This means that a function test can be carried out for the switching device, for example, even when an elevator door is open, when the permanent magnet 14 attached to the door is located in an inoperative position relative to the sensor 12.

As shown in FIG. 2, a sensor 12 can be used for the practical realization of an inventive switching device for performing the inventive method which comprises a Hall sensor 18 in the form of an integrated circuit with an open-drain output and a pull-up resistor 20 connected thereto. In this respect, the one connection of this resistor 20 is connected to a connection terminal, to which a supply voltage $V_{DD}$ is applied, while the other connection is connected to a circuit point 22 which forms an input of an internal control circuit 24 of the sensor electronics 10. The control circuit 24 which is part of the sensor electronics 10 supplies an output signal for an activating block 26, to which a second input signal can be supplied for activating the magnetic coil 16 via a signal line 28 which can be connected via a corresponding input circuit 30 with a primary control, namely a bus control 32 (cf. FIG. 3), and on its output side can be connected via an output circuit 34 with additional sensor electronic circuits which belong to additional non-contact, electronic switching devices.

In response to the signals at its inputs, the activating block 26 supplies a control signal, by which a transistor 36 is switched into the conductive state so that a current can flow through the exciter coil 38 of the magnetic coil 16, whereby a reverse diode 40 (=bypass diode for the back emf) is connected in parallel to the exciter coil 38 in a conventional manner.

In the switching device shown in FIG. 2, the sensor electronics 10 comprises, in addition, a data input line 42 and a data output line 44, whereby these two lines are each provided with an input circuit and an output circuit. The data input line 42 represents an ascending data path starting from the bus control 32 (FIG. 3), via which the sensor electronic circuits 10 of all the switching devices belonging to a safety chain are connected together. The signal line 28 and the data input line 42 with their associated input circuits therefore correspond to the input E which is only schematically indicated in FIG. 1. In a corresponding manner, the data output line 44, which corresponds to the output A in FIG. 1, represents a data path leading back to the bus control 32 from the connected switching devices. The data input line 42 is connected with a receiver part 46 which scans the data passing through the data input line 42 and forms an input register. In this respect, the receiver part 46 is provided, in addition, with an input connected to the control circuit 24. A changeover device or switch 48 is inserted into the data output line 44. The changeover switch is controlled by the output signal of an OR-gate 50, the two inputs of which are connected with the circuit point 22 and with an output of a sender part 52, respectively, to connect either the data output of the sender part 52, which supplies status and address signals, or the input side of the data output line 44 with its output side. The sender part 52 is connected via an additional output and an additional input to the control circuit 24. As indicated in FIG. 2, the sensor electronics 10 comprises a conventional timing generator (not shown) and is fed from a schematically indicated voltage supply 56 which generates the regulated supply voltage $V_{DD}$ of, e.g., 5 V from a, possibly, unregulated input voltage of 24 V. The voltage $V_{DD}$ is applied both to the sensor 12 and to the magnetic coil 16.

In the switching device under consideration, the open-drain output of the Hall sensor 18 is pulled by the resistor 20 to the supply voltage $V_{DD}$ when the magnetic field is lacking and to reference potential when the magnetic field is present. These voltages are applied to the circuit point 22. If an exciter current now flows through the magnetic coil 16 when the switching device is first of all actuated, i.e. proceeding from a state, in which the permanent magnet 14 acts on the sensor 18 and the circuit point 22 is at reference potential, this will compensate the magnetic field already present at the sensor 18 so that the voltage $V_{DD}$ is supplied to the circuit point 22. This signal change indicates a faultless functioning of the sensor 18 as the most important part of the switching device.

FIG. 3 shows how the sensor electronic circuits 10.1 to 10.n of n testable electronic switching devices are connected to form a safety chain and also connected to the associated bus control 32 forming a primary control in order to actuate a switch 58 in a motor switching circuit 60. In detail, n sensor electronic circuits 10.1, 10.2 to 10.n are provided. As explained for the switching device according to FIG. 2, a sensor 12.1 to 12.n and a magnetic coil 16.1 to 16.n are associated with each of these sensor electronic circuits, whereby each sensor interacts with a permanent magnet 14.1 to 14.n. The permanent magnets 14.1 to 14.n are, in the embodiment according to FIG. 3, each connected to a door 15.1 to 15.n as a movable component which is to be monitored. The individual magnetic coils 16.1 to 16.n can be activated via the lines 28 and 42 for test purposes in order to ascertain whether the associated switching devices are operating perfectly. When a function test is to be carried out, a coil activating signal is applied to the line 28 while the individual switching devices or sensor electronic circuits are addressed via the line 42. The answer-back signal concerning the faultless functioning of the individual switching devices and their switching state is passed via the line 44. When all the switching devices are operating perfectly and all the doors are in the correct position, the switch 58 of the motor switching circuit 60 can be actuated via the bus control 32, which can, if necessary, be connected with additional bus controls belonging to other safety chains, as indicated in FIG. 3 by pairs of input and output lines for the bus control 32. The motor relay 64 located in this motor switching circuit is then activated and closes the motor switching circuit 66, in which a motor 68 and a voltage source 70 are connected in series, via its switching contact 64*a*.

A closer look at the circuit diagram according to FIG. 3 makes it clear that the parts of the line 42 connected with one another and the parts of the line 44 connected with one another form a closed loop together with a cross connection 43 between the data input line 42 and the data output line 44 of the sensor electronics 10.n which is the most remote from the bus control 32, on the condition that the switches 48 are all in such a position that they create a through connection. This loop can serve as a monitoring loop, the ascending branch of which is connected at its input side to an output of the bus control 32 and the returning branch of which is connected at its end with an input of the bus control 32. A continuous signal can be transmitted from the bus control 32 via this monitoring loop and its presence at the returning branch of the loop monitored so that, ultimately, a type of stand-by current loop is formed. When the bus control 32 transmits a sequence of digital signals to the monitoring loop instead of a simple continuous signal, such as, e.g., of a predetermined direct current voltage level, then a "digital stand-by current loop" is obtained which offers particularly favourable monitoring possibilities, whereby the bus control 32 checks whether the sequence of signals received on the returning branch corresponds to the sequence of signals sent.

The circuit arrangement shown in FIG. 3 can be supplemented in an additional development of the invention such that between the upper end of the ascending branch and the beginning of the descending branch a signal converter 72 is inserted into the cross connection 43 between the two branches, as indicated by dashed lines. This signal converter converts the sequence of digital signals incoming via the ascending branch of the monitoring loop in a defined manner into an altered sequence of digital signals. This means that it is, in particular, possible to detect those faults which are based on an undesired cross connection between the ascending branch and the descending or returning branch of the monitoring loop. Cross connections of this type can, for example, result due to short circuits in the individual sensor electronic circuits.

It is clear from the preceding description that the inventive monitoring device facilitates a relatively simple construction of a complete control unit and ensures a reliable, interruption-free operation thereof.

We claim:

1. Apparatus for monitoring an electrical control system in which a plurality of electronic switching units are coupled to form a safety chain, said switching units each having a non-contacting, testable sensor and control electronics associated therewith for detecting and altering the state of said sensor, comprising:

an ascending branch leading from a primary control to communicate signals from said primary control to successive ones of said switching units coupled along said ascending branch;

a return branch leading from the last one of said switching units coupled to said ascending branch back to said primary control via said successive switching units, said ascending and return branches being coupled together at said last one of said switching units to form a monitoring loop; and an electronic changeover device associated with each of said successive switching units for interrupting said return branch when the sensor associated with that switching unit is not in a state fulfilling a safety criterion for said safety chain.

2. Apparatus in accordance with claim 1 wherein said primary control is adapted to generate a continuous signal for communication along said monitoring loop and to detect an interruption of said continuous signal from said loop.

3. Apparatus in accordance with claim 2 wherein:

said continuous signal comprises a defined sequence of pulses; and said primary control monitors pulses received from said return branch with respect to their conformity with the defined sequence of pulses.

4. Apparatus in accordance with claim 3 wherein said ascending and return branches are coupled together at said last one of said switching units via a signal converter for converting said sequence of pulses in a defined manner into an altered sequence of pulses for monitoring by said primary control.

5. Apparatus in accordance with claim 1 wherein said primary control comprises addressing devices for individually addressing a receiver provided in each of said switching units, and each of said switching units comprises a sender for supplying status information concerning that switching unit to the primary control via said return branch.

6. Apparatus in accordance with claim 1 wherein said sensors comprise magnetic field sensors for monitoring the state of a mechanical locking mechanism with a displaceable permanent magnet.

7. Apparatus in accordance with claim 6 wherein a test coil selectively activatable by said control electronics is associated with the sensor of each switching unit for generating a magnetic field compensating the magnetic field of the permanent magnet.

8. Apparatus in accordance with claim 1 wherein said control electronics are designed to perform a logical information control of data fed thereto.

9. Apparatus in accordance with claim 1 wherein said control electronics are designed as a test device for the logical information control of the function of its associated sensor.

10. Apparatus in accordance with claim 1 wherein the state of each sensor is interrogatable individually by said primary control.

11. Apparatus in accordance with claim 10 wherein all of said sensors are monitorable with respect to a uniform state by the primary control with the aid of a continuous signal on the monitoring loop.

12. Apparatus in accordance with claim 10 wherein said primary control comprises addressing devices for individually addressing a receiver provided in each of said switching units, and each of said switching units comprises a sender for supplying status information concerning that switching unit to the primary control via said return branch.

13. Apparatus in accordance with claim 1 wherein said primary control comprises:

means for generating a test signal on a first path to actuate the sensors associated with said switching units during a test; and addressing devices for individually addressing each of said switching units one at a time via a second path to detect the state of its associated sensor during said test.

14. Apparatus in accordance with claim 13 wherein said second path is said ascending branch, and said primary control detects the actuation of said sensors during said test via said return branch.

15. An electronic switching unit for use in an electrical control system in which a plurality of such units are coupled to form a safety chain, said switching unit comprising:

a non-contacting, testable sensor;

control electronics for detecting and altering the state of said sensor;

an ascending branch terminal for coupling said unit to an ascending branch that communicates signals from a primary control of said electrical control system to a succession of said units;

a return branch terminal for coupling said unit to a return branch leading back to said primary control via said succession of units; and an electronic changeover device for interrupting said return branch when said sensor is not in a state fulfilling a safety criterion for said safety chain.

16. A switching unit in accordance with claim 15 wherein said sensor comprises a magnetic field sensor for monitoring the state of a mechanical locking mechanism with a displaceable permanent magnet.

17. A switching unit in accordance with claim 16 wherein a test coil selectively activatable by said control electronics is associated with said sensor for generating a magnetic field compensating the magnetic field of the permanent magnet.

18. A switching unit in accordance with claim 15 wherein the state of said sensor is interrogatable individually by said primary control.

19. A switching unit in accordance with claim 15 further comprising:

an addressable receiver for receiving communications addressed thereto from said primary control via said ascending branch; and a sender for supplying status information concerning the switching unit to the primary control via said return branch.

20. A switching unit in accordance with claim 15 further comprising a test terminal for receiving a sensor actuation signal from said primary control during a test; wherein:

said control electronics are addressable via said ascending branch terminal to detect the state of said sensor during said test, and said changeover device is responsive to said control electronics during said test to interrupt said return branch when said unit is addressed via said ascending branch.

* * * * *